United States Patent [19]

Irwin et al.

[11] 4,335,632

[45] Jun. 22, 1982

[54] INTERNAL PIPE WRENCH

[75] Inventors: Lawrence F. Irwin, Sylmar; Robert Millray, Saugus, both of Calif.

[73] Assignee: Augerscope, Inc., Sylmar, Calif.

[21] Appl. No.: 199,746

[22] Filed: Oct. 23, 1980

Related U.S. Application Data

[63] Continuation-in-part of Ser. No. 971,071, Jan. 5, 1979, abandoned.

[51] Int. Cl.[3] ..... B25B 23/08

[52] U.S. Cl. ..... 81/446; 81/449

[58] Field of Search ..... 81/72, 441, 443, 446, 81/448, 449; 279/2 R; 242/72.1; 269/48.1

[56] References Cited

U.S. PATENT DOCUMENTS

| | | | |
|---|---|---|---|
| 573,325 | 12/1896 | Gates | 81/72 |
| 1,335,660 | 3/1920 | Conley | 7/157 |
| 1,428,035 | 9/1922 | Jarmolowsky | 81/72 |
| 1,887,009 | 11/1932 | Buttress | 81/72 |
| 2,657,605 | 11/1953 | Howell | 81/72 |
| 2,675,724 | 4/1954 | Beyer | 81/72 |
| 2,678,217 | 5/1954 | King | 279/2 |
| 2,800,043 | 7/1957 | Young | 81/72 |

*Primary Examiner*—James L. Jones, Jr.
*Attorney, Agent, or Firm*—James E. Brunton

[57] ABSTRACT

An internal pipe wrench adapted to engage the inner walls of a pipe for applying torque thereto. The wrench comprises a rotatable mandrel which is generally triangular in cross-section and three cooperating gripping jaws movable into gripping engagement with the pipe upon rotation of the mandrel. The gripping jaws are retained in operable proximity with the mandrel by means of a yieldably resilient rubber or plastic material and are uniformly configured so that upon rotation of the mandrel in either direction, the leading edge of the gripping jaws will move into positive gripping engagement with the inner walls of the pipe.

7 Claims, 14 Drawing Figures

INTERNAL PIPE WRENCH

BACKGROUND OF THE INVENTION

This application is a Continuation-in-Part application of copending application Ser. No. 971,071 filed Jan. 5, 1979, now abandoned.

FIELD OF THE INVENTION

The present invention relates generally to pipe wrenches and more particularly to an internal pipe wrench adapted to engage the inner wall of a pipe or other tubular member for purposes of applying torque thereto.

DISCUSSION OF THE PRIOR ART

Internal pipe wrenches of various construction have been suggested in the past. Typically these wrenches comprise an outer body adapted to carry a plurality of circumferentially spaced jaws having tooth like serrations which are movable by camming arrangements of various designs into gripping engagement with the inner walls of the pipe. In many of the prior art devices the gripping jaws are carried within apertures formed in the walls of the outer body and are moved radially outwardly by a tapered mandrill movable longitudinally within the body. This type of device is exemplified by the patents to Currier U.S. Pat. No. 1,992,474 and to Ostas U.S. Pat. No. 2,273,982.

Another type of prior art wrench embodies tapered keys adapted to move the gripping jaws into gripping engagement with the walls of the pipe. This type of wrench is illustrated and described in the U.S. Pat. No. to Parks 3,276,297. Still another type of camming arrangement is illustrated in the patent to Howell U.S. Pat. No. 2,651,605. In this last mentioned patent, the camming device consists of a rotatable, polygonal shaped mandrel adapted to move the gripping jaws into engagement with the walls of the pipe.

Although prior art internal wrenches of conventional design as exemplified by those discussed in the preceding paragraphs have met with varying degrees of acceptance, none has proved completely effective in actual practice. Many of the wrenches are quite expensive to manufacture and are relatively unreliable in use. For example, wrenches having tapered jaw actuating mandrels typically exhibit a tendency to slip and the serrated jaws often tend to severely abrade and disform the internal surfaces of the pipe. Further, these types of wrenches are rotation sensitive, in that they function to grip the pipe only in one direction of rotation. This prevents the application of a rocking action to loosen troublesome joints.

Unlike the wrench of the present invention, various of the prior art devices, particularly those using polygonal shaped mandrels, are constructed so that the trailing, rather than the leading edge of the gripping jaws engage the pipe upon rotation of the mandrel. Such a construction is most undesirable and often results in the wrench slipping within the pipe because of the poor gripping action of the jaws against the inner surface of the pipe.

The wrench of the present invention overcomes the drawbacks of the prior art devices by providing a tool which is the ultimate of simplicity and yet is highly durable and extremely effective in actual use. In the novel construction of the wrench of the present invention the expensive and often difficult to manufacture jaw retaining body typically found in the prior art devices is eliminated. In its place there is provided a unique, inexpensive and easily formable encapsulating material which locates the gripping jaws in operable proximity with a novel rotatable actuating mandrel of simple configuration. In the form of the invention claimed herein the mandrel is generally triangular in cross-section and the gripping jaws are uniquely configured so that upon rotation of the mandrel in either direction the leading edge of the gripping jaws will be brought into positive gripping engagement with the interior walls of the pipe.

In addition to those previously discussed, applicant is familiar with the following prior art patents which serve to illustrate the novelity of the wrench of the present invention:

U.S. Pat. Nos. 1,535,534; 1,887,009; 2,675,724; 2,800,043; 3,861,251; 532,765; 573,325.

SUMMARY OF THE INVENTION

It is an object of the present invention to provide a simple, inexpensive and highly effective gripping tool for gripping the walls of a tubular part such as a length of pipe or the like.

More particularly, it is an object of the present invention to provide an internal pipe wrench designed to engage in and rotate for purposes of connection with or removal from mating couplings, short lengths of piping.

It is another object of the invention to provide an internal pipe wrench of the aforementioned character in which in operation a plurality of gripping jaws are moved into positive gripping action with the inner walls of the pipe by the rotation of a mandrel which is of highly simple construction being generally triangular in cross-section.

It is another object of the invention to provide a device of the type described in the preceding paragraph in which the gripping jaws are retained in contact with the mandrel by a thin walled, yieldably resilient material which, because of the unique design of the device, is nonload bearing in operation of the wrench.

It is a further important object of the invention to provide a wrench of the character described in which the gripping jaws are uniquely configured so that upon rotation of the mandrel in either direction, the leading edge of the jaws will positively engage the inner wall of the pipe. With this configuration a rocking action of the mandrel may be employed to loosen particularly troublesome joints.

It is another object of the invention to provide a wrench of the class described in which the yieldably resilient jaw retaining material along with the jaws can readily be removed as a unit from the mandrel for replacement by another unit having gripping jaws of different size so that the same mandrel can be used on pipe having differing internal diameters. Alternately the wrench can be provided with an elongated mandrel adapted to carry, in tandem, gripping jaws of different sizes. With this construction, because of the flexibility of the jaw retaining unit, it can readily be removed from the mandrel and turned end for end so that the simple wrench can be used in connection with pipes of two standard sizes.

It is another object of the invention to provide a wrench of the aforementioned character in which the gripping jaws are configured so as to securely grip the inner surfaces of the pipe without cutting, tearing or otherwise damaging the pipe.

It is another object of the invention to provide a wrench of the class described which includes a removable reaming attachment adapted to remove built-up corrosion within the pipe upon rotation of the mandrel of the wrench or during a broaching action by the reaming attachment.

It is still another object of the invention to provide an improved wrench of the indicated species which is simple in construction, embodies a minimum number of moving parts, is easy to operate, is highly durable and reliable, and is inexpensive to produce and maintain.

These and other objects of the invention are realized by an internal pipe wrench comprising a rotatable, polygonal mandrel having a plurality of longitudinally extending faces; a plurality of gripping members each having a bottom mandrel engaging surface and an upper surface defining spaced apart wall engaging edges and a yieldably resilient retaining member for retaining the bottom surfaces of each of the gripping members in close proximity with a corresponding face of the mandrel for limited movement with respect thereto, whereby when the wrench is in operating position within a pipe or other tubular member increased rotational movement of the mandrel in either direction causes the leading wall engaging edge of each of each of the gripping members to move into positive gripping engagement with the inner wall of the pipe or other tubular member.

DESCRIPTION OF THE PREFERRED EMBODIMENTS OF THE INVENTION

Figure 1:
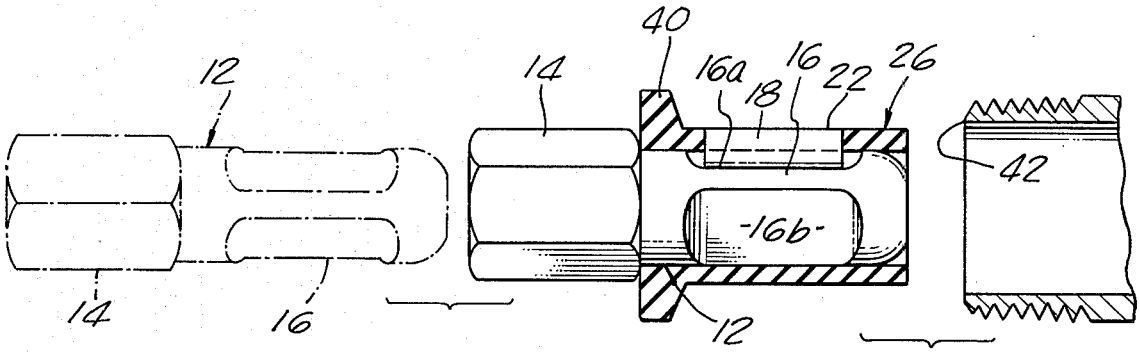
FIG. 1 is a side elevational view partly in section of the Internal Wrench of one form of the invention.
Figure 2:
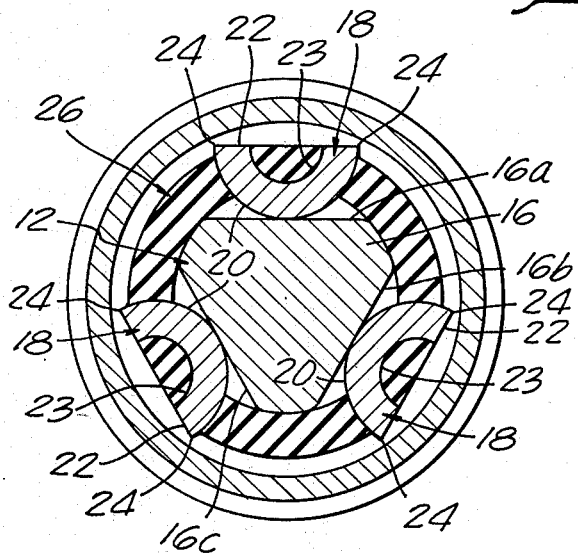
FIG. 2 is an enlarged transverse cross-sectional view of the wrench shown in FIG. 1.

Referring to the drawings, and particularly to FIGS. 1 and 2 the Internal Wrench comprises an elongated rotatable mandrel 12 having means 14 provided at one end which means are engagable by wrench to turn a mandrel and a shank portion 16. As best seen by referring to FIG. 2, shank portion 16 is generally triangular in cross-section and has three longitudinally extending substantially flat faces 16*a*, 16*b* and 16*c*. Also forming a part of the Internal Wrench of this form of the invention, are three identically configured gripping members 18, eadh having a bottom mandrel-engaging surface 20 and an upper surface 22 defining spaced apart wall engaging edges 24. Gripping members, or jaws, 18 are each of a width somewhat less than the width of the faces 16*a* of mandrel 16 and are generally semicircular in cross-section. Each jaw is provided with a longitudinally extending semicircular shaped channel 23, the purpose of which will presently be described. As shown in FIG. 1, the edge portions 24 of the gripping jaws extend longitudinally of the wrench and are substantially parallel to the edges of the faces 16*a* of the mandrel 16.

To position the gripping jaws with the curved lower surface 20 thereof in close proximity with a corresponding face of the mandrel 16, there is provided retaining means. In this form of the invention, the retaining means comprises a yieldably resilient generally cylindrically-shaped thin wall collet member 26. Member 26 may be constructed of any durable and suitably yieldably resilient material such as rubber, synthetic rubber, neoprene, plastic or the like, which is adapted to at least partially encapsulate the gripping jaws 18 so as to position them in close proximity with the mandrel 16 whereby upon insertion of the wrench into a tubular member, increased rotational movement of the mandrel in either direction will cause the leading edge of each gripping jaw to move into positive gripping engagement with the inner wall of the tubular member. As best seen by referring to FIG. 2, the gripping jaws are partially encapsulated within the walls of the collet with the resilient material of the collet formed about and adhering to the curved walls of each jaw and also filing the longitudinally extending channels 23 thereof. With this construction the collet and gripping jaws form an integral assembly which, due to the resiliency of the collet material, permits the assembly to be readily removed from the mandrel. The resiliency of the collet material also permits the jaws to move radially inwardly and outwardly with respect to the faces of the mandrel and to move transversely relative to the faces of the mandrel upon rotational forces being imparted to the mandrel.

Figure 3:
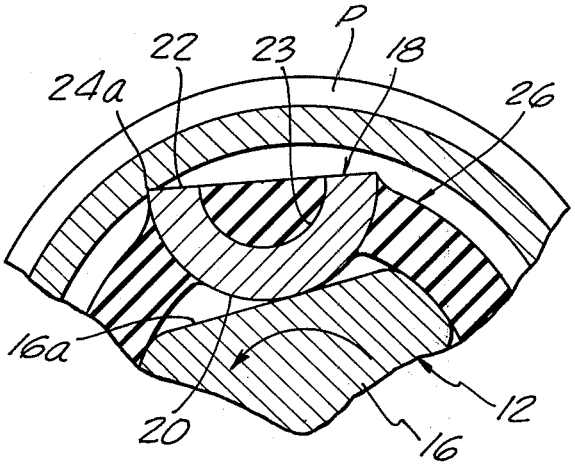
FIG. 3 is an enlarged fragmentary cross-sectional view similar to FIG. 2 illustrating the way in which the gripping means of the wrench moves into engagement with the pipe upon rotation of the central mandrel in one direction.

Referring now to FIG. 3, rotational movement of mandrel 12 in a counter clockwise direction as indicated by the arrow will result in a rocking or rotational movement of jaws 18 relative to surfaces 16a of the shank of mandrel 12. This rocking or rotational movement will, because of the unique design of the gripping jaws, cause the leading edge, designated 24a in FIG. 3, to move into positive gripping engagement with the internal wall of the pipe P into which the wrench has been inserted.

Figure 4:
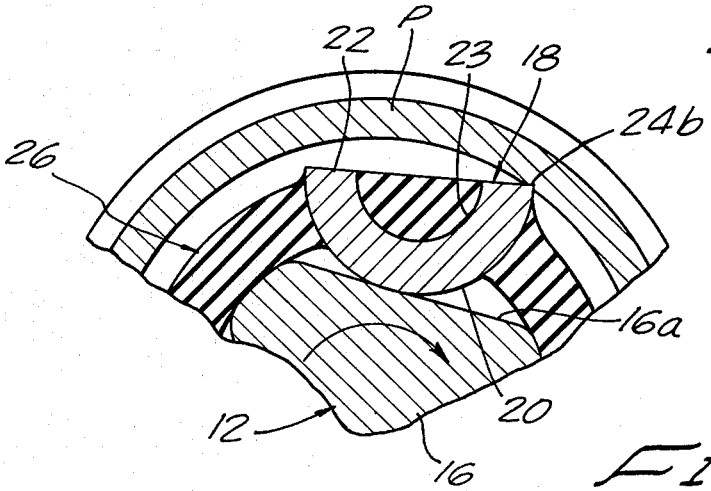
FIG. 4 is an enlarged fragmentary cross-sectional view similar to FIG. 3 illustrating the movement of the gripping means of the wrench upon rotation of the mandrel in the opposite direction.

Referring to FIG. 4, it can be seen that rotational movement of mandrel 12 in a clockwise direction as indicated by the arrow will cause rotational or rocking movement of jaw 18 relative to surface 16a of mandrel 12 whereby the leading edge of the jaw designated in FIG. 4 as 24b will move into positive gripping engagement with the inner surface of the pipe P into which the wrench has been inserted.

It is the unique interaction of the component parts of the wrench as thus described which results in the gripping jaws thereof moving into positive gripping engagement with the inner surface of the pipe when the mandrel is rotated in either direction. This novel construction permits the wrench to be used to impart torque to a pipe in both a tightening and loosening direction so that through this rocking movement, particularly troublesome pipe joints can effectively be loosened.

Due to the yieldably resilient nature of the material from which the retaining means, or collet member 26, is constructed and because of the radii formed at either end of the flat surfaces of mandrel 16, the assemblage made up of the retaining means and the gripping jaws 18 can readily be removed from the shank portion 16 of the mandrel 12. By providing auxilliary assemblages comprising a retaining means and jaws 18 of a larger size, the wrench can effectively be used for loosening pipe having differing internal diameters. For example, if it was desired to use the wrench shown in FIG. 1 on a pipe P' having a larger internal diameter than that shown in FIG. 1, the assemblage of member 26 and gripping jaws 18 would be removed from the shank portion 16 of the mandrel 12. A new assemblage, comprising a member 26 and jaws 18 of a slightly greater height would then be replaced over the shank of the mandrel, the larger jaws would rock in the same manner illustrated in FIGS. 3 and 4 so that the leading edge thereof would move into engagement with the internal walls of the larger size pipe.

It is to be understood that although the configuration of the wrench shown in FIGS. 1 and 2 embodies a mandrel which is triangular in cross-section and which uses three gripping jaws, a mandrel having four or five flat sides and a corresponding number of gripping jaws could be used even though its effectiveness might be somewhat lessened.

Figure 5:
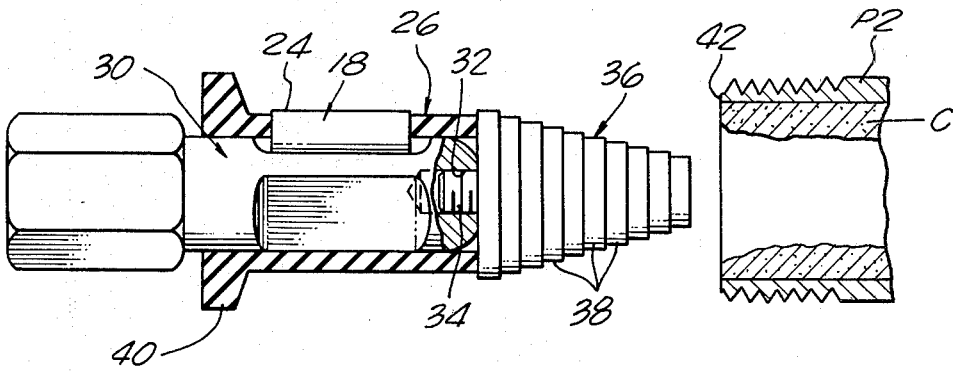
FIG. 5 is a side elevational view partly in section and partly broken away to show internal construction of another embodiment of the wrench of the present invention.

Referring to FIG. 5, there is shown another form of the wrench of the present invention. In this form of the wrench, the retaining means, or collet member 26 and gripping jaws 18 are of similar construction to that previously described. The mandrel 30 of this form of the invention, is, however, differently configured being provided with a threaded aperture 32 at the forward end of the mandrel. Threadably receivable within threaded aperture 32 is a threaded shank portion 34 of a reamer attachment 36 adapted to remove built up corrosion C formed within the interior of a pipe section P2. As illustrated in FIG. 5, reaming attachment 36 is provided with a plurality of cutting edges 38 of differing diameters. With this arrangement, as the reaming attachment is moved axially inwardly of a corroded pipe, the cutting edges 38 will progressively remove the corrosion until a stable bare metal surface is reached. Continued axially inward movement of the wrench will place the gripping jaws 18 in a position proximate the freshly cleaned inner walls of the pipe P2. Rotation of the mandrel 30 will then cause jaws 18 to move into posotive gripping engagement with the clean inner wall of the pipe in the manner previously described. This insures a positive gripping contact between the pipe and the gripping jaws 18.

It is to be noted that in the embodiments of the invention shown in FIGS. 1 through 5, the outer diameter of the collet member 26 is somewhat smaller than the inner diameter of the tubular member or pipe P and P2. It is also to be noted that in the form of the invention there shown a flange 40 is formed at one end of the collet member. In using the wrench illustrated in FIGS. 1 through 5, the collet member can be freely inserted into the pipe until the flange 40 moves into frictional engagement with the end surface 42 of the pipe. Slight inward pressure on the wrench will then permit the mandrel 16 to be rotated relative to the collet causing the jaws 18 to be moved into positive gripping engagement with the internal walls of the pipe in the manner illustrated in FIGS. 3 and 4.

Figure 6:
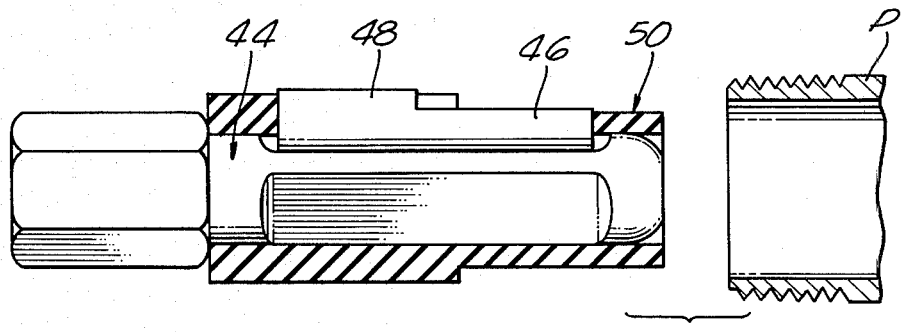
FIG. 6 is a side elevational view partly in section of still another form of the Internal Wrench of the present invention.
Figure 7:
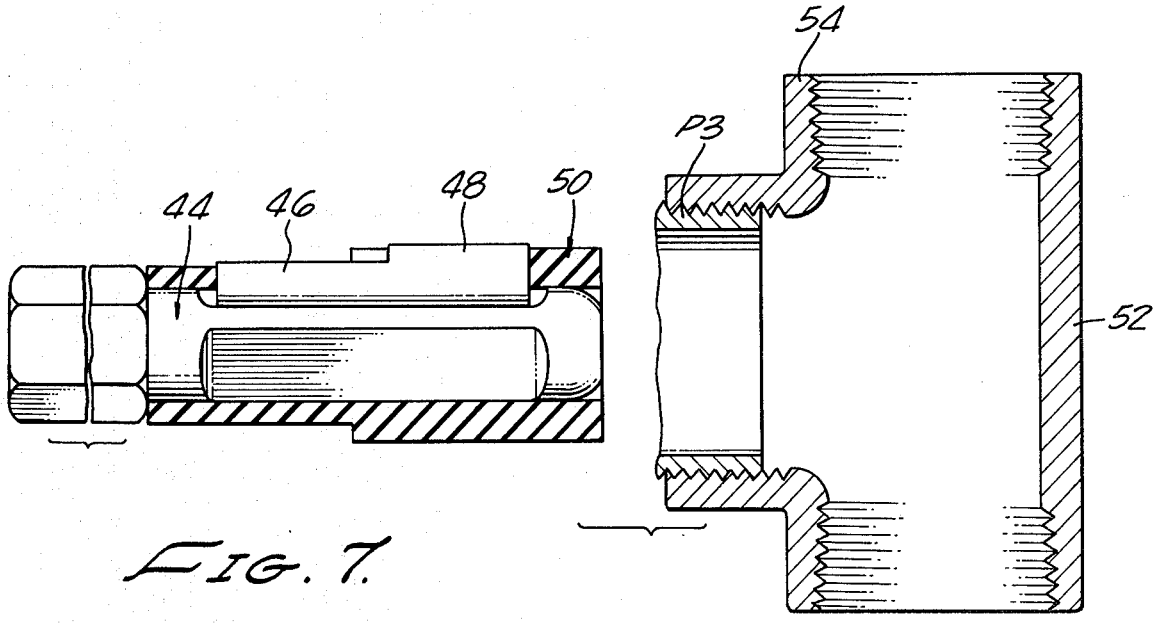
FIG. 7 is a view similar to FIG. 6 but illustrating the appearance of the wrench with the gripping means thereof turned end for end ready for insertion into a pipe "T".

Referring to FIGS. 6 and 7 of the drawings, there is shown another form of the wrench of the present invention. In this form, the collet 50 and the mandrel 44 are configured similarly to the collet and mandrel of the embodiments previously described, but are elongated. Collet 50 is adapted to carry in tandem gripping jaws 46 and 48 of different heights adapted to be used with pipe of different internal diameters. Gripping jaws 46 and 48 may be formed from a single piece of material or may be separately formed. In either event, each jaw is of a construction similar to that previously described being provided with a curved bottom mandrel-engaging surface and an upper surface defining spaced apart wall-engaging edges of the type previously described herein. Jaws 46 and 48 interact with mandrel 44 so that upon rotation of the mandrel the particular set of jaws positioned within the pipe will be moved into positive gripping engagement with the internal walls of the pipe in the same manner as illustrated in FIGS. 3 and 4. By way of example, with the wrench positioned on the mandrel in the manner shown in FIG. 6, upon insertion of the wrench into the pipe P, the jaws 46 will be brought into close proximity with the internal walls of the pipe P. Rotation of the mandrel 44 will then cause jaws 46 to move into positive gripping engagement with the internal walls of pipe P.

If it is desired to use the wrench to impart torque to a pipe section or a pipe "T" of larger diameter, the assemblage made up of the collet member 50 and the jaws 46 and 48 can be removed from the mandrel, turned end for end and replaced upon the mandrel to form the configuration shown in FIG. 7. With this configuration, it is to be observed that the larger size jaws 48 are now disposed proximate the forward, or right-hand end of the mandrel 44. With this configuration, the wrench can be inserted into a pipe of larger diameter to impart rotational torque thereto.

An important feature of the embodiment of the invention shown in FIGS. 6 and 7 resides in the fact that with this unique construction, the wrench can be used to loosen pipe sections affixed to other pipe components, such as pipe "T"s which limit the extent to which the wrench can be inserted into the pipe section. For example, as illustrated in FIG. 7, the wrench of this form of the invention can be inserted into the pipe section P3 and the jaws moved into gripping engagement with the pipe in the manner previously described without the end of mandrel 44 engaging the end wall 52 of the "T" 54. Obviously, if it were not for the reversible collet feature of this form of the invention, the wrench in the configuration illustrated in FIG. 6 could not be used to loosen a pipe section of larger diameter wherein the degree of axial movement of the wrench was limited, as would be the case with a pipe "T", a pipe coupling or other similar pipe component. By simply turning the collet 50 end for end on the mandrel, however, the plumber can readily use the tool to loosen the larger diameter pipe section P3 (FIG. 7) which is threaded into the "T" 54.

Figure 8:
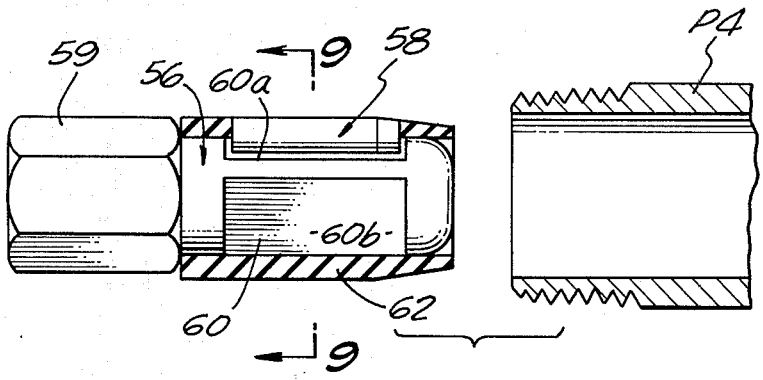
FIG. 8 is a side elevational view partly in section showing yet another embodiment of the internal wrench of the invention.
Figure 9:
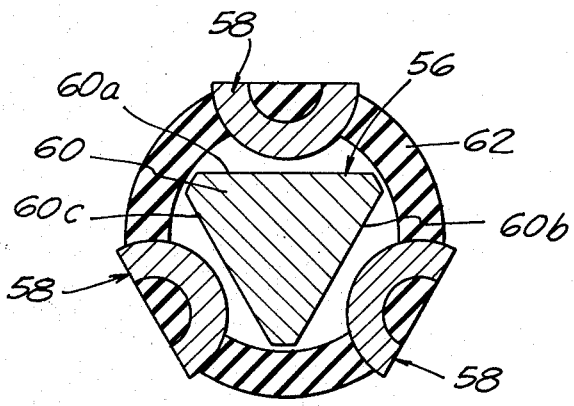
FIG. 9 is an enlarged cross-sectional view taken along lines 9—9 of FIG. 8.
Figure 10:
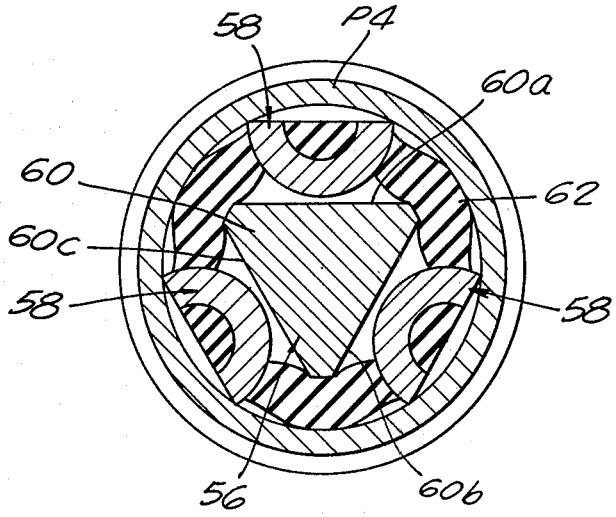
FIG. 10 is a cross-sectional view showing the appearance of the wrench illustrated in FIG. 8 after it has been inserted into the pipe.

Turning now to FIGS. 8 through 10 of the drawings, there is illustrated still another embodiment of the present invention. In this form of the invention, the mandrel 56 and the jaws 58 are of similar construction to those shown in FIGS. 1 through 5. The rotatable mandrel 56 is provided at one end with wrench-engaging means 59 and has at its other end a shank portion 60 which is generally triangular in cross-section and has three longitudinally extending, substantially flat faces 60*a*, 60*b* and 60*c*.

The principal difference between the wrench shown in FIGS. 8 through 10 from that shown in FIGS. 1 through 5 resides in the fact that the collet member 62 is of a slightly larger diameter and is adapted to be closely received within the pipe section P4 to which rotational torque is to be applied. As best seen by referring to FIG. 9, in this form of the invention, the jaws 58 are positioned by the retaining means of collet 62 in a location slightly spaced apart from mandrel 60. When the wrench is inserted into the pipe section P4, the edge portions of the jaws 58, which define a cylinder having a diameter closely proximating the internal diameter of the pipe section, move into engagement of the inner wall of the pipe section P4. Continued axial movement of the wrench into the pipe section will cause the yieldably resilient collet member 62 to deform in the manner shown in FIG. 10 so as to bring the jaws 58 into operative proximity with the mandrel 60. To facilitate introduction of the wrench into the pipe, the leading edge of the collet 62 as well as the leading edges of the jaws 58, is slightly tapered in the manner shown in FIG. 8.

It is to be noted that in the form of the wrench shown in FIGS. 8 through 10, it is not necessary to provide a flange portion on the rearward, or trailing edge, of the collet 62. Because the collet 62 is of a diameter closely corresponding to the inner diameter of the pipe section which is to be removed, the frictional engagement between the collet 62 and the inner walls of the pipe P4 will permit the mandrel 60 to be rotated relative to the collet so as to move the jaws into increasing positive engagement with the internal wall of the pipe much in the same manner as illustrated in FIGS. 3 and 4 of the drawings. This construction makes it unnecessary to apply an axial force on the wrench to prevent rotation of the collet as was the case with the embodiments shown in FIGS. 1 through 5.

Because of the manner of operation of the wrench of this embodiment of the invention, it is preferable that the collet 62 not be removable from the mandrel 60 when inserting or removing the tool from the pipe. Accordingly, there are no radii formed on the leading and trailing edges of the flat surfaces of the mandrel 60.

Several advantages result from the form of the invention shown in FIGS. 8 through 10. In addition to the fact that axial pressure need not be exerted on the wrench to prevent the collet from rotating within the pipe upon rotation of the mandrel, the design of the mandrel is such that there is no tendency of the collet and jaws to slide off the mandrel when the wrench is removed from the pipe section. Additionally, because of the unique design of the collet and the built-in clearance between the jaws and the mandrel when the wrench is in a free state, the collet has the ability to closely adjust to the particular internal diameter of the pipe as the wrench is inserted therein. Accordingly when the wrench is in an operating position within the pipe the collet is stabilized in one location within the pipe and has no tendency to rotate when rotational forces are applied to the mandrel. Thusly, the mandrel may be turned freely within the collet to bring the leading edges of the jaws into positive engagement with the internal walls of the pipe section or pipe fitting.

In this embodiment, like each of the previously described embodiment, the collet is nonload bearing during operation of the wrench.

Figure 11:
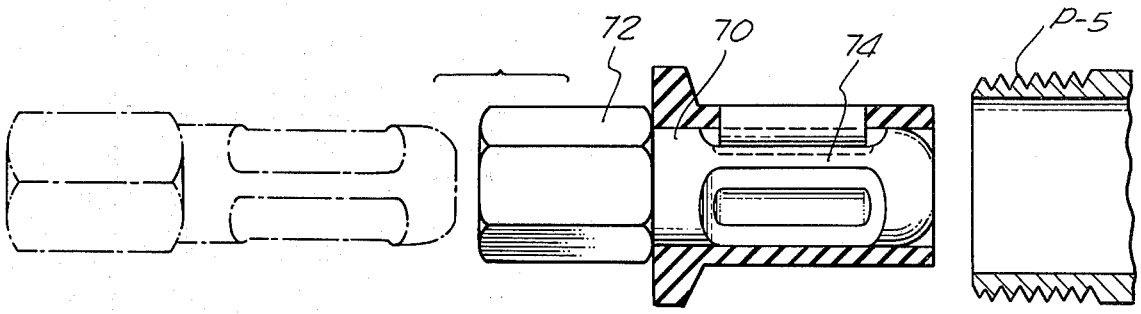
FIG. 11 is a side elevational view partly in section similar to FIG. 1 but illustrating another form of internal wrench of the present invention.
Figure 12:
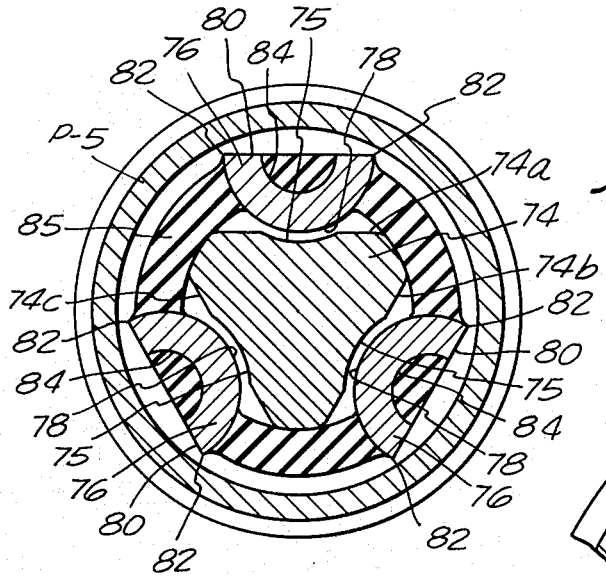
FIG. 12 is an enlarged transverse cross-sectional view of the wrench shown in FIG. 11.
Figure 13:
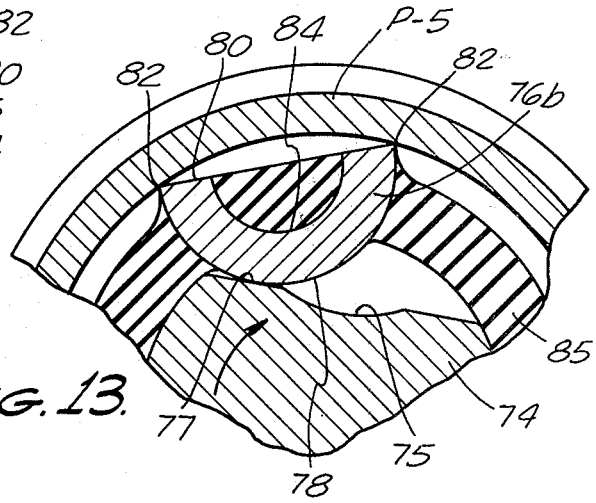
FIG. 13 is an enlarged fragmentary cross-sectional view similar to FIG. 12 illustrating the manner in which the gripping means of the wrench moves into engagement with the pipe upon rotation of the central mandrel in one direction.
Figure 14:
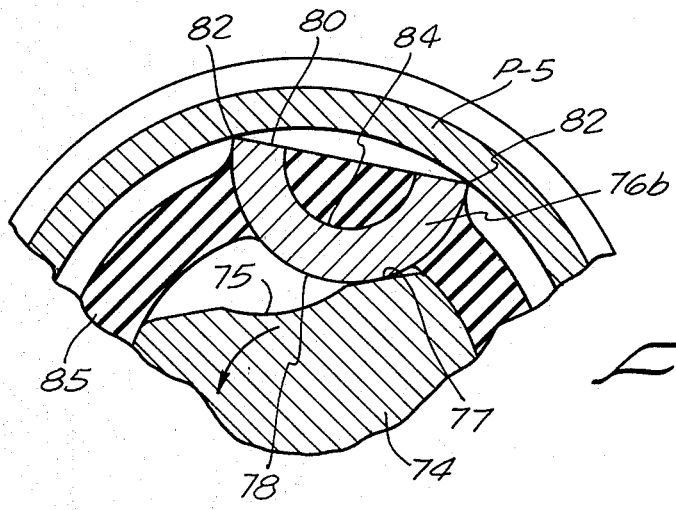
FIG. 14 is an enlarged fragmentary cross-sectional view similar to FIG. 13 illustrating the movement of the gripping means of the wrench upon rotation of the mandrel in the opposite direction.

Referring now to FIGS. 11 through 14 there is shown yet another form of the Internal Wrench of the invention which comprises an elongated rotatable mandrel 70 having means 72 provided at one end which means are engagable by wrench to turn a mandrel and a shank portion 74. As best seen by referring to FIG. 12, shank portion 74 is generally triangular in cross-section but in this form of the invention has three longitudinally extending faces 74*a*, 74*b* and 74*c* each of which is provided with a longitudinally extending, concave groove or channel 75. Also forming a part of the Internal Wrench of this form of the invention, are three identically configured gripping members 76, each having a curved bottom mandrel-engaging surface 78 and an upper surface 80 defining spaced apart wall engaging edges 82 (FIG. 13). Gripping members, or jaws, 76 are each of a width somewhat less than the with of the faces of mandrel 74 and are generally semicircular in cross-section. Each jaw is provided with a longitudinally extending semicircular shaped channel 84, the purpose of which will presently be described. As shown in FIG. 11, the edge portions 82 of the gripping jaws extend longitudinally of the wrench and are substantially parallel to the edges of the faces of the mandrel 74. As shown in FIG. 12, groove 75 provides a finite amount of clearance to permit inward radial movement of the gripping members 76 to accommodate for corrosion or variations in the internal diameter of the pipe section P-5.

To position the gripping jaws with the curved lower surface 78 thereof in close proximity with a channel 75 formed in a corresponding face of the mandrel 74, there is provided retaining means. In this form of the invention, the retaining means is similar to that previously described and comprises a yieldably resilient generally cylindrically-shaped thin wall collet member 85. As in the earlier described embodiments, member 85 may be constructed of any durable and suitable yieldably resilient material such as rubber, synthetic rubber, neoprene, plastic or the like, which is adapted to at least partially encapsulate the gripping jaws 76 so as to position them in close proximity with the concave face of the mandrel 74 whereby upon insertion of the wrench into a tubular member, increased rotational movement of the mandrel in either direction will cause the gripping jaws to move into position gripping engagement with the inner wall of the tubular member.

In the embodiments of the invention as earlier described rotational movement of the mandrel resulted in a rocking or rotational movement of the jaws so as to cause the leading edge (designated 24*a* in FIG. 3) to move into positive gripping engagement with the internal wall of the pipe P into which the wrench has been inserted.

Referring to FIG. 13, it can be seen that in the instant form of the invention rotational movement of mandrel 74 in clockwise direction as indicated by the arrow will cause movement of jaw 76 relative to surface 75 of the mandrel 74 whereby the jaw will move out of the channel 75 and into engagement with the flat portion 77 of the mandrel. This will cause the jaw designated in FIG. 13 as 76*b* to move radially outwardly into positive gripping engagement with the inner surface of the pipe P-5 with both edges 82 of the jaw moving into biting engagement with the pipe. As previously mentioned, the configuration of the mandrel of this form of the invention also provides additional clearance between the mandrel and the jaws 76 to facilitate the introduction of the tool into pipes having various internal diameters.

The unique interaction of the component parts of the wrench of this form of the invention results in both gripping edges 82 of each of the jaws moving simultaneously into positive gripping engagement with the inner surface of the pipe when the mandrel is rotated in either direction. This is because the jaws are not rocking, but rather are in substance moving along an inclined ramp formed by the rotating mandrel. With the edges 82 of the jaws in engagement with the pipe, torque can be imparted to a pipe in both a tightening and loosening direction so that a rocking movement, particularly troublesome pipe joints can effectively be loosened.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A gripping tool for gripping the inner walls of a tubular member for purposes of applying torque thereto, comprising:

(a) a rotatable, polygonal mandrel having a plurality of longitudinally extending faces;

(b) a plurality of gripping members each having a bottom mandrel engaging surface and an upper surface defining spaced apart wall engaging edges, said wall engaging edges and said mandrel engaging surface lying in planes substantially parallel with said longitudinally extending faces of said mandrell; and (c) yieldably resilient retaining means for retaining said bottom surfaces of each of said gripping members in close proximity with a corresponding face of said mandrel for limited movement with respect thereto, whereby when the wrench is in operating position within the tubular member increased rotational movement of said mandrel in either direction causes the leading wall engaging edge of each of said gripping members to move into gripping engagement with the inner wall of said tubular member; said retaining means comprising a generally cylindrically shaped thin wall collett member formed of a yieldably resilient material within which said gripping members are partially encapsulated and adapted for limited raidal movement with respect to said mandrel, said collett member being substantially coextensive in length with said gripping members and having a diameter substantially equal to the inner diameter of said tubular member.

2. A gripping tool as defined in claim 1 in which said collett member is formed of rubber and includes a flange of increased diameter disposed at one end thereof and adapted to frictionally engage the edge portion of the tubular member whereby said mandrel can be rotated relative to said cylindrically shaped member.

3. A gripping tool for gripping the inner walls of a tubular member for purposes of applying torque thereto, comprising:

(a) a rotatable, polygonal mandrel having a plurality of longitudinally extending faces;

(b) a plurality of gripping members each having a bottom mandrel engaging surface and an upper surface defining spaced apart wall engaging edges, said wall engaging edges and said mandrel engaging surface lying in planes substantially parallel with said longitudinally extending faces of said mandrell; and (c) yieldably resilient retaining means for retaining said bottom surfaces of each of said gripping members in close proximity with a corresponding face of said mandrel for limited movement with respect thereto, whereby when the wrench is in operating position within the tubular member increased rotational movement of said mandrel in either direction causes the leading wall engaging edge of each of said gripping members to move into gripping engagement with the inner wall of said tubular member; said retaining means comprising a generally cylindrically shaped collet member having a body portion substantially coextensive in length with said gripping members and a forward tapering portion, said body portion having a diameter slightly larger than the inside diameter of the tubular member.

4. A gripping tool as defined in claim 3 in which said collet member is adapted to position said mandrel engaging surface of said gripping members in a spaced apart parallel relationship with said faces of said mandrel whereby axial movement of said collet into said tubular member will cause said mandrel engaging surfaces of said gripping members to move radially inwardly into engagement with said faces of said mandrel.

5. A gripping tool as defined in claim 4 in which said collet member and said gripping members comprise an integral assembly which is readily removable from said mandrel for replacement by alternate collet member or gripping member assemblies of different diameters.

6. A gripping tool as defined in claim 3 in which said mandrel is configured such that rotational movement of said mandrel in either direction will cause the wall engaging edges of each of said gripping members to move simultaneously into gripping engagement with the inner walls of said tubular member.

7. A gripping tool for gripping the inner walls of a tubular member for purposes of applying torque thereto, comprising:

(a) a rotatable mandrel having a plurality of longitudinally extending faces, each said face being provided with a concave channel extending a substantial distance along the length of the surface;

(b) a plurality of gripping members each having a curved bottom surface at least partially receivable in said channels and an upper surface defining spaced apart wall engaging edges said wall engaging edges lying in planes substantially parallel with said longitudinally extending faces of said mandrel; and (c) yieldably resilient retaining means for retaining said bottom surfaces of each of said gripping members in close proximity with a channel formed in the face of said mandrel for limited movement with respect thereto, whereby when the wrench is in operating position within the tubular member increased rotational movement of said mandrel in either direction causes the wall engaging edges of each of said gripping members to move into gripping engagement with the inner wall of said tubular member; said retaining means comprising a generally cylindrically shaped collet member having a body portion substantially coextensive in length with said gripping members, a forward tapering portion, and a flange of increased diameter disposed at one end thereof adapted to frictionally engage the tubular member.

* * * * *